US008906465B2

(12) United States Patent
Ogawa et al.

(10) Patent No.: US 8,906,465 B2
(45) Date of Patent: Dec. 9, 2014

(54) METHOD FOR FORMING MULTILAYER COATING FILM

(75) Inventors: Junya Ogawa, Toyota (JP); Koji Kanagawa, Toyota (JP); Shuichi Nakahara, Aichi-ken (JP); Tadashi Iida, Aichi-ken (JP); Hiroyuki Nagano, Aichi-ken (JP); Yoshizumi Matsuno, Aichi-ken (JP); Yasushi Nakao, Aichi-ken (JP)

(73) Assignees: Toyota Jidosha Kabushiki Kaisha, Aichi (JP); Kansai Paint Co., Ltd., Hyogo (JP)

( * ) Notice: Subject to any disclaimer, the term of this patent is extended or adjusted under 35 U.S.C. 154(b) by 737 days.

(21) Appl. No.: 12/452,808

(22) PCT Filed: Jul. 18, 2008

(86) PCT No.: PCT/JP2008/063458

§ 371 (c)(1),
(2), (4) Date: Jan. 22, 2010

(87) PCT Pub. No.: WO2009/014226

PCT Pub. Date: Jan. 29, 2009

(65) Prior Publication Data

US 2010/0129662 A1 May 27, 2010

(30) Foreign Application Priority Data

Jul. 24, 2007 (JP) ..... 2007-192238

(51) Int. Cl.

| | |
|---|---|
| ***B05D 5/00*** | (2006.01) |
| ***B05D 3/02*** | (2006.01) |
| ***B05D 7/00*** | (2006.01) |
| *B05D 1/02* | (2006.01) |

(52) U.S. Cl.

CPC ..... *B05D 7/574* (2013.01); *B05D 3/0254* (2013.01); *B05D 7/572* (2013.01); *B05D 2202/10* (2013.01)

USPC ..... 427/407.1; 427/402; 427/372.2; 427/385.5; 428/413

(58) Field of Classification Search

None

See application file for complete search history.

(56) References Cited

U.S. PATENT DOCUMENTS

| | | | | |
|---|---|---|---|---|
| 5,196,485 | A * | 3/1993 | McMonigal et al. | 525/327.3 |
| 6,458,463 | B1 | 10/2002 | Yoshioka et al. | |
| 6,534,127 | B2 | 3/2003 | Ohmoto et al. | |
| 6,743,867 | B1 | 6/2004 | Flosbach et al. | |
| 2002/0090461 | A1 * | 7/2002 | Ohmoto et al. | 427/402 |
| 2002/0107306 | A1 * | 8/2002 | Wang et al. | 523/412 |
| 2004/0030003 | A1 * | 2/2004 | Wegner et al. | 523/171 |

FOREIGN PATENT DOCUMENTS

| | | |
|---|---|---|
| DE | 199 17 232 | 10/2000 |
| EP | 0 676 455 | 10/1995 |
| EP | 1 764 161 | 3/2007 |
| GB | 2 399 520 | 9/2004 |
| JP | 2002-282773 | 10/2002 |
| JP | 2004-298838 | 10/2004 |
| WO | 2007/026919 | 3/2007 |
| WO | 2007/145368 | 12/2007 |

OTHER PUBLICATIONS

International Search Report issued Mar. 10, 2009 along with the Written Opinion in International (PCT) Application No. PCT/JP2008/063458.

Office Action issued Jul. 4, 2012 in corresponding German Application No. 11 2008 001 822.7 (with English translation).

* cited by examiner

*Primary Examiner* — Michael Cleveland
*Assistant Examiner* — Francisco Tschen
(74) *Attorney, Agent, or Firm* — Wenderoth, Lind & Ponack, L.L.P.

(57) ABSTRACT

This invention provides a method for forming multilayer coating film excelling in smoothness and distinctness of image, by 3-coat-1-bake system in which a step of applying onto a coating object a water-based intermediate paint (X) to form an intermediate coating film; a step of adjusting the solid content of the intermediate coating film to 70-100 mass %; a step of applying onto the intermediate coating film a water-based base coating paint (Y) containing 30-55 mass parts of alcoholic solvent having a boiling point of 170-250° C., to form a base coating film; a step of adjusting the solid content of the base coating film to 70-100 mass %; a step of applying a clear paint (Z) comprising 40-60 mass parts of carboxyl-containing compound and 60-40 mass parts of polyepoxide onto the base coating film to form a clear coating film; and heating the intermediate coating film, base coating film and clear coating film at 100-120° C. for 3-10 minutes and thereafter further heating them at 130-160° C. for 10-30 minutes; are successively carried out.

10 Claims, No Drawings

METHOD FOR FORMING MULTILAYER COATING FILM

This application is a U.S. national stage of International Application No. PCT/JP2008/063458 filed Jul. 18, 2008.

TECHNICAL FIELD

This invention relates to a method for forming multilayer coating film having excellent appearance, by 3-coat-1-bake system comprising successively applying onto a coating object, water-based first coloring paint, water-based second coloring paint and clear paint, and heat-curing the resulting 3-layered multilayer coating film simultaneously.

BACKGROUND ART

As coating methods of car bodies, generally those for forming multilayer coating film by 3-coat-2-bake (3C2B) system comprising, after applying an electrocoating paint on the coating object, application of intermediate paint→curing by baking→application of water-based base coating paint→preheating (preliminary heating)→application of clear paint→curing by baking, have been widely adopted. Whereas, for energy-saving, attempts are made in recent years to omit the bake-curing step after application of intermediate paint and adopt 3-coat-1-bake (3C1B) system comprising, after applying an electrocoating paint on the coating object, application of water-based intermediate paint→preheating (preliminary hearing)→application of water-based base coating paint→preheating (preliminary heating)→application of clear paint→curing by baking (e.g., see JP 2002-282773A).

However, because the intermediate paint, base coating paint and clear paint are applied one on another in uncured condition in the above 3-coat-1-bake system, layer mixing is apt to take place between adjacent coating films, which occasionally impairs smoothness or distinctness of image of resulting coating film.

As a countermeasure to the trouble, JP-2004-275966A discloses a method for forming laminar coating film excelling in finished appearance and chipping resistance, by carrying out the bake-curing step in multistages of low temperature-heating stage and high temperature-heating stage, each under specific temperature-time conditions. This coating film-forming method, however, is subject to problems that sufficient smoothness and distinctness of image may not be obtained when water-based paints are used as the intermediate paint and base coating paint.

DISCLOSURE OF THE INVENTION

The object of the present invention is to provide a method for forming multilayer coating film excelling in smoothness and distinctness of image by 3-coat-1-bake system using water-based intermediate paint and water-based base coating paint.

We have engaged in concentrative studies for accomplishing the above object and now discovered that multilayer coating film excelling in smoothness and distinctness of image could be formed by applying a specific water-based base coating paint on an intermediate coating film which has been adjusted to have a specific solid content, adjusting the solid content of the base coating film to a specific value, then applying a specific clear paint, and curing the intermediate coating film, base coating film and clear coating film simultaneously under specific heating conditions, in the coating steps of multilayer coating film by 3-coat-1-bake system using a water-based intermediate paint and water-based base coating paint. The present invention is thus completed.

Accordingly, therefore, the invention provides a method for forming multilayer coating film on a coating object, which is characterized by successively carrying out the following steps (1-6):

(1) a step of applying a water-based intermediate paint (X) to form an intermediate coating film, (2) a step of adjusting the solid content of the intermediate coating film which is formed in the step (1) to 70-100 mass %, (3) a step of forming a base coating film by applying onto the intermediate coating film as obtained in the step (2) a water-based base coating paint (Y) containing 30-55 mass parts, per 100 mass parts of the solid resin content of the paint, of an alcoholic solvent having a boiling point of 170-250° C., (4) a step of adjusting the solid content of the base coating film which is formed in the step (3) to 70-100 mass %, (5) a step of forming a clear coating film by applying onto the base coating film as obtained in the step (4) a clear paint (Z) containing 40-60 mass parts of carboxyl-containing compound and 60-40 mass parts of polyepoxide, per 100 mass parts of the solid resin content of the paint, and (6) a step of curing the intermediate coating film, base coating film and clear coating film, which are formed in the steps (1)-(5), simultaneously, by heating them at 100-120° C. for 3-10 minutes and thereafter further heating them at 130-160° C. for 10-30 minutes.

According to the multilayer coating film-forming method of the present invention, multilayer coating film excelling in smoothness and distinctness of image can be formed on coating objects by 3-coat-1-bake system.

Hereinafter the multilayer coating film-forming method of the invention is explained in further details, by the order of each of the above steps.

Step (1):

In this step a water-based intermediate paint (X) is applied onto a coating object to form an intermediate coating film.

Coating Objects

The coating objects to which a water-based intermediate paint (X) is applicable according to the invention are not particularly limited and, for example, can be outer panel portions of car bodies such as automobiles, trucks, motorcycles, buses and the like; car parts; and outer panel portions of household electric appliances such as mobile telephones and audio instruments. In particular, outer panels of car bodies and car parts are preferred.

The materials making up such coating objects are not particularly limited, which include, for example, metallic materials such as iron, aluminum, brass, copper, tin plate, stainless steel, zinc-plated steel, alloyed zinc (e.g. Zn—Al, Zn—Ni, Zn—Fe)-plated steel and the like; plastic materials including resins such as polyethylene resin, polypropylene resin, acrylonitrile-butadiene-styrene (ABS) resin, polyamide resin, acrylic resin, vinylidene chloride resin, polycarbonate resin, polyurethane resin, epoxy resin and the like and various FRP; inorganic materials such as glass, cement, concrete and the like; wood; fibrous materials (e.g., paper, fabric). Of these, metallic materials and plastic materials are preferred.

The coating objects may be metal surfaces of above metallic materials or of car bodies made thereof, which have been given a surface treatment such as phosphate treatment, chromate treatment or complex oxide treatment. Furthermore, the coating objects may be those metallic substrates, can bodies and the like, on which undercoating film such as of various electrodeposition coatings has been formed. In particular, car bodies on which an undercoating film of cationic electrodeposition coating is formed are preferred.

Water-Based Intermediate Paint (X)

As the water-based intermediate paint (X) to be coated on above coating objects, water-based liquid paint containing thermosetting resin component and water which, where necessary, is further blended with organic solvent, coloring pigment, extender, effect pigment, surface-regulating agent, antisettling agent and the like, can be used. In the present specification, water-based paint signifies a paint whose chief component is water.

As the thermosetting resin component, per se known resin compositions for paint can be used, which are formed of base resin (A) having crosslinkable functional groups such as hydroxyl group and hydrophilic functional groups such as carboxyl group, for example, polyester resin, acrylic resin, vinyl resin, alkyd resin, urethane resin and the like; and crosslinking agent (B), for example, amino resin, optionally blocked polyisocyanate compound and the like.

In particular, it is recommendable to use as the base resin (A) a hydroxyl-containing acrylic resin (A1) and/or hydroxyl-containing polyester resin (A2), and as the crosslinking agent (B), amino resin (B1) and/or blocked polyisocyanate compound (B2).

Hydroxyl-containing acrylic resin (A1) can be prepared, for example, by (co)polymerizing at least one unsaturated monomeric component comprising hydroxyl-containing unsaturated monomer and optionally still other unsaturated monomer copolymerizable therewith (at least one of those monomers constituting the monomeric component being acrylic) under conventional conditions.

Hydroxyl-containing unsaturated monomer is a compound having at least one each of hydroxyl group and polymerizable bond per molecule, examples of which including monoesterification products of (meth)acrylic acid with $C_{2-8}$ dihydric alcohol, such as 2-hydroxyethyl (meth)acrylate, 2-hydroxypropyl (meth)acrylate, 3-hydroxypropyl (meth)acrylate and 4-hydroxybutyl (meth)acrylate; ϵ-caprolactone-modified monoesters of (meth)acrylic acid with $C_{2-8}$ dihydric alcohol; allyl alcohol; (meth)acrylates having polyoxyethylene chain of hydroxyl-terminated molecule.

In the present specification, (meth)acrylate collectively refers to acrylate and methacrylate, and (meth)acrylic acid collectively refers to acrylic acid and methacrylic acid.

Examples of other unsaturated monomers copolymerizable with above hydroxyl-containing unsaturated monomer include: alkyl or cycloalkyl (meth)acrylates such as methyl (meth)acrylate, ethyl (meth)acrylate, n-propyl (meth)acrylate, i-propyl (meth)acrylate, n-butyl (meth)acrylate, i-butyl (meth)acrylate, tert-butyl (meth)acrylate, n-hexyl (meth) acrylate, octyl (meth)acrylate, 2-ethylhexyl (meth)acrylate, nonyl (meth)acrylate, tridecyl (meth)acrylate, lauryl (meth) acrylate, stearyl (meth)acrylate, "Isostearyl Acrylate" (tradename, Osaka Organic Chemical Industry, Ltd.), cyclohexyl (meth)acrylate, methylcyclohexyl (meth)acrylate, t-butylcyclohexyl (meth)acrylate, cyclododecyl (meth)acrylate and the like; isobornyl-containing unsaturated monomers such as isobornyl (meth)acrylate; adamantyl-containing unsaturated monomers such as adamantyl (meth)acrylate, aromatic ring-containing unsaturated monomers such as styrene, α-methylstyrene, vinyltoluene, phenyl (meth)acrylate and the like; alkoxysilyl-containing unsaturated monomers such as vinyltrimethoxysilane, vinyltriethoxysilane, vinyltris(2-methoxyethoxy)silane, γ-(meth)acryloyloxypropyltrimethoxysilane, γ-(meth)acryloyloxypropyltriethoxysilane and the like; perfluoroalkyl (meth)acrylates such as perfluorobutylethyl (meth)acrylate, perfluorooctylethyl (meth)acrylate and the like; fluorinated alkyl-containing unsaturated monomers such as fluoroolefins; unsaturated monomers containing photopolymerizable functional group such as maleimide group; vinyl compounds such as N-vinylpyrrolidone, ethylene, butadiene, chloroprene, vinyl propionate, vinyl acetate and the like; carboxyl-containing unsaturated monomers such as (meth)acrylic acid, maleic acid, crotonic acid, β-carboxyethyl acrylate and the like; nitrogen-containing unsaturated monomers such as (meth)acrylonitrile, (meth)acrylamide, dimethylaminopropyl (meth)acrylamide, dimethylaminoethyl (meth)acrylate, adducts of glycidyl (meth)acrylate with amines, and the like; epoxy-containing unsaturated monomers such as glycidyl (meth)acrylate, β-methylglycidyl (meth)acrylate, 3,4-epoxycyclohexylmethyl (meth)acrylate, 3,4-epoxycyclohexyethyl (meth)acrylate, 3,4-epoxycyclohexylpropyl (meth)acrylate, allylglycidyl ether and the like; (meth)acrylates having polyoxyethylene chain of alkoxy-terminated molecule; sulfonic acid group-containing unsaturated monomers such as 2-acylamido-2-methylpropanesulfonic acid, allylsulfonic acid, sodium styrenesulfonate, sulfoethyl methacrylate and sodium salt or ammonium salt thereof; phosphoric acid group-containing unsaturated monomers such as 2-acryloyloxyethyl acid phosphate, 2-methacryloyloxyethyl acid phosphate, 2-acryloyloxypropyl acid phosphate, 2-methacryloyloxypropyl acid phosphate and the like; ultraviolet-absorbing group-containing unsaturated monomers such as 2-hydroxy-4-(3-methacryloyloxy-2-hydroxypropoxy)benzophenone, 2-hydroxy-4-(3-acryloyloxy-2-hydroxypropoxy)benzophenone, 2,2'-dihydroxy-4-(3-methacryloyloxy-2-hydroxypropoxy)benzophenone, 2,2'-dihydroxy-4-(3-acryloyloxy-2-hydroxypropoxy)benzophenone, 2-(2'-hydroxy-5'-methacryloyloxyethylphenyl)-2H-benzotriazole and the like; unsaturated monomers having ultraviolet ray-stabilizing ability such as 4-(meth)acryloyloxy-1,2,2,6,6-pentamethylpiperidine, 4-(meth)acryloyloxy-2,2,6,6-tetramethylpiperidine, 4-cyano-4-(meth)acryloylamino-2,2,6,6-tetramethylpiperidine, 1-(meth)acryloyl-4-(meth)acryloylamino-2,2,6,6-tetramethylpiperidine, 1-(meth)acryloyl-4-cyano-4-(meth)acryloylamino-2,2,6,6-tetramethylpiperidine, 4-crotonoyloxy-2,2,6,6-tetramethylpiperidine, 4-crotonoylamino-2,2,6,6-tetramethylpiperidine, 1-crotonoyl-4-crotonoyloxy-2,2,6,6-tetramethylpiperidine and the like; and carbonyl-containing unsaturated monomeric compounds such as acrolein, diacetone acrylamide, diacetone methacrylamide, acetoacetoxyethyl methacrylate, formylstyrol, $C_{4-7}$ vinyl alkyl ketones (e.g., vinyl methyl ketone, vinyl ethyl ketone, vinyl butyl ketone) and the like. These can be used either alone or in combination of two or more.

From the viewpoint of storage stability or water resistance of formed coating film, such hydroxyl-containing acrylic resin (A1) can have a hydroxyl value within a range of generally 1-200 mgKOH/g, preferably 2-100 mgKOH/g, inter alia, 3-60 mgKOH/g; and an acid value within a range of generally 1-200 mgKOH/g, preferably 2-150 mgKOH/g, inter alia, 5-100 mgKOH/g. The hydroxyl-containing acrylic resin (A1) can also have an weight-average molecular weight within a range of generally 1,000-5,000,000, preferably 2,000-3,000,000, inter alia, 3,000-1,000,000.

The blend ratio of the hydroxyl-containing acrylic resin (A1) can be within a range of normally 2-90 mass parts, preferably 5-60 mass parts, inter alia, 10-40 mass parts, per 100 mass parts of combined solid content of the base resin (A) and crosslinking agent (B) (hereafter referred to as the resin component) in the water-based intermediate paint (X).

The hydroxyl-containing polyester resin (A2) can be prepared, for example, by esterification reaction or ester-interchange reaction of a polybasic acid component and a polyhydric alcohol component, more specifically, for example, by an esterification at an equivalent ratio (COOH/OH) between the carboxyl group in the polybasic acid component and the hydroxyl group in the polyhydric alcohol component of less than 1, in the state that more hydroxyl groups are present than carboxyl groups.

The polybasic acid component is a compound having at least two carboxyl groups per molecule, examples of which include polybasic acids such as phthalic acid, isophthalic acid, terephthalic acid, succinic acid, gluaric acid, adipic acid, azelaic acid, sebacic acid, tetrahydrophthalic acid, hexahydrophthalic acid, maleic acid, fumaric acid, itaconic acid, trimellitic acid, pyromellitic acid and the like; anhydrides thereof, lower alkyl esters of these polybasic acids; and the like. These may be used either alone or in combination of two or more.

The polyhydric alcohol component is a compound having at least two hydroxyl groups per molecule, examples of which include α-glycols such as ethylene glycol, 1,2-propylene glycol, 1,2-butylene glycol, 2,3-butylene glycol, 1,2-hexanediol, 1,2-dihydroxycyclohexane, 3-ethoxypropane-1,2-diol, 3-phenoxypropane-1,2-diol and the like; neopentyl glycol, 2-methyl-1,3-propanediol, 2-methyl-2,4-pentanediol, 3-methyl-1,3-butanediol, 2-ethyl-1,3-hexanediol, 2,2-diethyl-1,3-propanediol, 2,2,4-trimethyl-1,3-pentanediol, 2-butyl-2-ethyl-1,3-propanediol, 2-phenoxypropane-1,3-diol, 2-methyl-2-phenylpropane-1,3-diol, 1,3-propylene glycol, 1,3-butylene glycol, 2-ethyl-1,3-octanediol, 1,3-dihydroxycyclohexane, 1,4-butanediol, 1,4-dihydroxycyclohexane, 1,5-pentanediol, 1,6-hexanediol, 2,5-hexanediol, 3-methyl-1,5-pentanediol, 1,4-dimethylolcyclohexane, tricyclodecanedimethanol, 2,2-dimethyl-3-hydroxypropyl-2,2-dimethyl-3-hydroxypropionate (an ester of hydroxypivalic acid with neopentyl glycol), bisphenol A, bisphenol F, bis(4-hydroxyhexyl)-2,2-propane, bis(4-hydroxyhexyl)methane, 3,9-bis(1,1-dimethyl-2-hydroxyethyl)-2,4,8,10-tetraoxaspiro[5,5]undecane, diethylene glycol, triethylene glycol, glycerine, diglycerine, triglycerine, pentaerythritol, dipentaerythritol, sorbitol, mannitol, trimethylolethane, trimethylolpropane, ditrimethylolpropane, tris(2-hydroxyethyl)isocyanurate and the like. These can be used either alone or in combination of two or more.

The esterification or ester-interchange reaction of above polybasic acid component with polyhydric alcohol component can be carried out by the means known per se, for example, by polycondensation of above polybasic acid component and polyhydric alcohol component, at about 180-about 250° C.

The hydroxyl-containing polyester resin (A2) may also be modified, where necessary, with fatty acid, monoepoxy compound and the like, either during the preparation of above polyester resin or after the esterification reaction. Examples of the fatty acid include coconut oil fatty acid, cotton seed oil fatty acid, hemp-seed oil fatty acid, rice bran oil fatty acid, fish oil fatty acid, tall oil fatty acid, soybean oil fatty acid, linseed oil fatty acid, tung oil fatty acid, rape oil fatty acid, castor oil fatty acid, dehydrated castor oil fatty acid, safflower oil fatty acid and the like; and examples of the monoepoxy compound include CARDURA E10P (tradename, HEXION Specialty Chemicals Co., glycidyl ester of synthetic highly branched saturated fatty acid) and the like.

The hydroxyl-containing polyester resin (A2) can have a hydroxyl value within a range of generally 10-300 mgKOH/g, in particular, 25-250 mgKOH/g, inter alia, 50-200 mgKOH/g, and an acid value within a range of generally 1-200 mgKOH/g, in particular, 5-100 mgKOH/g, inter alia, 10-60 mgKOH/g. Furthermore, the hydroxyl-containing polyester resin (A2) can have a weight-average molecular weight within a range of generally 500-50,000, in particular, 1,000-40,000, inter alia, 1,500-30,000.

The blend ratio of the hydroxyl-containing polyester resin (A2) can be normally within a range of 2-90 mass parts, preferably 10-60 mass parts, inter alia, 15-50 mass parts, per 100 mass parts of the total solid resin content of the water-based intermediate paint (X).

In the present specification, the number-average molecular weight or weight-average molecular weight are the converted values measured by gel permeation chromatograph using tetrahydrofuran as the solvent, with polystyrene of known molecular weight serving as the standard substance.

Those hydroxyl-containing acrylic resin (A1) and hydroxyl-containing polyester resin (A2) may be used concurrently with "urethane-modified polyester resin" or "urethane-modified acrylic resin" which are formed by extending such a resin by urethanation reaction of a part of hydroxyl groups therein with polyisocyanate compound to give it higher molecular weight.

It is furthermore desirable to neutralize a part or all of the carboxyl groups which may be contained in the hydroxyl-containing acrylic resin (A1) and hydroxyl-containing polyester resin (A2) with basic compound, to facilitate the resins' dissolution or dispersion in water. Examples of the basic compound include hydroxides of alkali metals or alkaline earth metals such as sodium hydroxide, potassium hydroxide, lithium hydroxide, calcium hydroxide, barium hydroxide and the like; ammonia; primary monoamines such as ethylamine, propylamine, butylamine, benzylamine, monoethanolamine, neopentanolamine, 2-aminopropanol, 2-amino-2-methyl-1-propanol, 3-aminopropanol and the like; secondary monoamines such as diethylamine, diethanolamine, di-n-propanolamine, di-isopropanolamine, N-methylethanolamine, N-ethylethanolamine and the like; tertiary monoamines such as dimethylethanolamine, trimethylamine, triethylamine, triisopropylamine, methyldiethanolamine, 2-(dimethylamino) ethanol and the like; and polyamines such as diethylenetriamine, hydroxyethylaminoethylamine, ethylaminoethylamine, methylaminopropylamine and the like. The use rate of the basic compound can be normally within a range of 0.1-1.5 equivalent, preferably 0.2-1.2 equivalent, to the acid groups in the base resin (A).

As the amino resin (B1), on the other hand, for example, partially or wholly methylolated amino resins, which are obtained by reaction of amino component such as melamine, urea, benzoguanamine, acetoguanamine, steroguanamine, spiroguanamine, dicyandiamide and the like, with aldehyde, can be used. Examples of the aldehyde include formaldehyde, paraformaldehyde, acetaldehyde, benzaldehyde and the like. Also these partially or wholly methylolated amino resins may further be partially or wholly etherified with alcohol. Examples of the alcohol useful for the etherification include methyl alcohol, ethyl alcohol, n-propyl alcohol, i-propyl alcohol, n-butyl alcohol, i-butyl alcohol, 2-ethylbutanol, 2-ethylhexanol and the like.

As the amino resin (B1), melamine resin is preferred. In particular, alkyl-etherified melamine resins such as methyl-etherified melamine resin obtained by partially or wholly etherifying with methyl alcohol the methylol groups in partially or wholly methylolated melamine resin, butyl-etherified melamine resin formed by partially or wholly etherifying the methylol groups with butyl alcohol, or methyl-butyl mixed etherified melamine resin formed by partially or wholly etherifying the methylol groups with methyl alcohol and butyl alcohol (preferably the methyl/butyl molar ratio therein ranging 9/1-3/7) are preferred.

The melamine resin preferably has an weight-average molecular weight normally within a range of 500-5,000, in particular, 600-4,000, inter alia, 700-3,000.

Where the melamine resin is used as the crosslinking agent (B), sulfonic acid such as paratoluenesulfonic acid, dodecylbenzenesulfonic acid, dinonylnaphthalenesulfonic acid or the like, or salts of these acids with amines can be used as catalyst.

As blocked polyisocyanate compound (B2), polyisocyanate compounds having at least two isocyanate groups per molecule, whose isocyanate groups are blocked with blocking agent such as oxime, phenol, alcohol, lactam, mercaptan or the like, can be used.

Suitable blend ratio of the base resin (A) and crosslinking agent (B) is such that the former is within a range of generally 40-90%, in particular, 50-80%; and the latter, generally 60-10%, in particular, 50-20%, based on the combined solid mass of these two.

Examples of the coloring pigment include titanium oxide, zinc oxide, Carbon Black, lead sulfate, calcium plumbate, zinc phosphate, aluminum phosphate, zinc molybdate, calcium molybdate, Prussian blue, ultramarine, cobalt blue, phthalocyanine blue, Indanthrone Blue, lead chromate, synthetic yellow iron oxide, clear red (yellow) iron oxide, bismuth vanadate, titanium yellow, zinc yellow, monoazo yellow, isoindolinone yellow, metal complex azo yellow, quinophthalone yellow, benzimidazolone yellow, red iron oxide, red lead, monoazo red, quinacridone red, azo lake (Mn salt), quinacridone magenta, anthanthrone orange, dianthraquinonyl red, perylene maroon, quinacridone magenta, perylene red, Diketopyrrolopyrol Chrome Vermilion, chlorinated phthalocyanine green, brominated phthalocyanine green, Pyrazolone Orange, Benzimidazolone Orange, Dioxazine Violet, Perylene Violet and the like. Of these, titanium oxide and Carbon Black can be conveniently used.

When the water-based intermediate paint (X) contains such coloring pigment, the blend ratio of the coloring pigment can be within a range of normally 1-120 mass parts, preferably 10-100 mass parts, inter alia, 15-90 mass parts, based on 100 mass parts of solid resin content of the water-based intermediate paint (X).

Examples of the extender pigment include clay, kaolin, barium sulfate, barium carbonate, calcium carbonate, talc, silica, alumina white and the like. Of those, use of barium sulfate and/or talc is preferred.

Where the water-based intermediate paint (X) contains such extender pigment, the blend ratio of the extender pigment can be within a range of normally 1-100 mass parts, preferably 5-60 mass parts, inter alia, 8-40 mass parts, per 100 mass parts of the solid resin content of water-based intermediate paint (X).

Examples of effect pigment include non-leafing or leafing aluminum (including vapor-deposited aluminum), copper, zinc brass, nickel, aluminum oxide, mica, titanium oxide- or iron oxide-coated aluminum oxide, titanium oxide- or iron oxide-coated mica, glass flake, hologram pigment and the like. These can be used either alone or in combination of two or more.

Where the water-based intermediate pigment (X) contains such effect pigment, its blend ratio can be within a range of normally 1-50 mass parts, preferably 2-30 mass parts, inter alia, 3-20 mass parts, per 100 mass parts of the solid resin content of the water-based intermediate paint (X).

The water-based intermediate paint (X) can be applied onto a coating object by the means known per se, for example, air spray, airless spray, rotary atomizing coater or the like. Static electricity may be impressed at the coating time. The coated film thickness can be normally 10-100 μm, preferably 10-50 μm, inter alia, 15-35 μm, in terms of cured film thickness.

Step (2):

The coating film of the water-based intermediate paint (X) (which hereafter may be referred to as intermediate coating film) as formed in the step (1) is adjusted of its solid content to 70-100 mass %, in particular, 75-99 mass %, inter alia, 80-98 mass %, before a water-based base coating paint (Y) is applied thereon.

Here the solid content of the intermediate coating film can be measured by the following method:

first, simultaneously with coating a water-based intermediate paint (X) onto a coating object, the same water-based intermediate paint (X) is applied also onto an aluminum foil whose mass ($W_1$) was measured in advance. Subsequently, the aluminum foil which is subjected to a preheating or the like similarly to the coating film of the water-based intermediate paint (X) is recovered immediately before application of a water-based base coating paint (Y), and its mass ($W_2$) is measured. Next, the recovered aluminum foil is dried at 110° C. for 60 minutes and allowed to cool off to room temperature in a desiccator. Measuring the mass ($W_3$) of the aluminum foil, the solid content is determined according to the following equation.

$$\text{Solid content of intermediate coating film (mass \%)}=\{(W_3-W_1)/(W_2-W_1)\}\times 100.$$

Adjustment of the solid content of intermediate coating film can be carried out by such means as preheating, air blowing or the like. Such preheating can be conducted normally by directly or indirectly heating the coated object in a drying over, at about 30-about 100° C., preferably at about 40-about 90° C., inter alia, at about 60-about 80° C., for 30 seconds-15 minutes, preferably 1-10 minutes, inter alia, 3-5 minutes. Also the air blowing can normally be conducted by blowing an ambient temperature air or air heated to about 25° C.-about 80° C. against the coated surface of the coating object.

Step (3):

Onto the intermediate coating film whose solid content is adjusted in the step (2), then a water-based base coating paint (Y) is coated.

Water-Based Base Coating Paint (Y)

The water-based base coating paint (Y) in the present invention includes water-based liquid paint comprising thermosetting resin component and water, and further comprising alcoholic solvent having a boiling point of 170-250° C., preferably 180-240° C., within a range of 30-55 mass parts, preferably 35-55 mass parts, per 100 mass parts of the solid resin content of the paint.

Examples of alcoholic solvent having a boiling point of 170-250° C. include 1-heptanol, 1-octanol, 2-octanol, 2-ethyl-1-hexanol, 1-decanol, benzyl alcohol, ethylene glycol mono-2-ethylhexyl ether, propylene glycol mono-n-butyl ether, dipropylene glycol mono-n-butyl ether, tripropylene glycol mono-n-butyl ether, propylene glycol mono-2-ethylhexyl ether, propylene glycol monophenyl ether and the like. Of those, 1-octanol, 2-octanol, 2-ethyl-1-hexanol and ethylene glycol mono-2-ethylhexyl ether can be favorably used.

Also as thermosetting resin component, resin compositions for paint which are known per se, composed of base resin (A) such as polyester resin, acrylic resin, vinyl resin, alkyd resin, urethane resin or the like which contain crosslinkable functional groups such as hydroxyl group and hydrophilic functional groups such as carboxyl group; and crosslinking agent (B) such as melamine resin, optionally blocked polyisocyanate compound and the like, as explained concerning the water-based intermediate paint (X) can be used.

In particular, it is preferable to use the earlier described hydroxyl-containing acrylic resin (A1) and/or hydroxyl-containing polyester resin (A2) as the base resin (A), and amino resin (B1) and/or blocked polyisocyanate compound (B2) as the crosslinking agent (B).

The water-based base coating paint (Y) can further contain, where necessary, pigment such as earlier described coloring pigment, extender, effect pigment and the like; and conventional paint additives such as curing catalyst, UV absorber, light stabilizer, defoamer, plasticizer, organic solvent, surface regulating agent, antisettling agent and the like, either alone or in suitable combination of two or more.

In particular, it is preferable for the water-based base coating paint (Y) to contain, as at least a part of its pigment component, an effect pigment, so as to be able to form an elaborate metallic tone or pearl tone coating film.

The water-based base coating paint (Y) can be coated by the means known per se, for example, air spray, airless spray, rotary atomizing coater or the like. Static electricity may be impressed at the coating time. The coating film thickness can be within a range of normally 5-40 μm, preferably 10-30 μm, in terms of cured film thickness.

Step (4):

The coating film of the water-based base coating paint (Y) (which hereafter may be referred to as base coating film) as formed in the step (3) is adjusted of its solid content to 70-100 mass %, in particular, 75-99 mass %, inter alia, 80-98 mass %, before a clear paint (Z) is applied thereon.

Here the solid content of the base coating film can be measured by the following method:

first, simultaneously with coating a water-based base coating paint (Y) onto the intermediate coating film, the same water-based base coating paint (Y) is applied also onto an aluminum foil whose mass ($W_4$) was measured in advance. Subsequently, the aluminum foil which is subjected to a preheating or the like similarly to the coating film of the water-based base coating paint (Y) is recovered immediately before application of a clear paint (Z), and its mass ($W_5$) is measured. Next, the recovered aluminum foil is dried at 110° C. for 60 minutes and allowed to cool off to room temperature in a desiccator. Measuring the mass ($W_6$) of the aluminum foil, the solid content is determined according to the following equation.

$$\text{Solid content of base coating film (mass \%)}=\{(W_6-W_4)/(W_5-W_4)\}\times 100.$$

Adjustment of the solid content of base coating film can be carried out by such means as preheating, air blowing or the like. Such preheating temperature can be about 30-about 100° C., preferably about 40-about 90° C., inter alia, about 60-about 80° C., and the preheating time can be 30 seconds-15 minutes, preferably 1-10 minutes, inter alia, 3-5 minutes. Also the air blowing can normally be conducted by blowing an ambient temperature air or air heated to about 25° C.-about 80° C. against the coated surface of the coating object.

Step (5):

Onto the base coating film whose solid content is adjusted in the step (4), further a clear paint (Z) is coated.

As the clear paint (Z), for example, a clear paint containing, based on 100 mass parts of solid resin component in the paint, 40-60 mass parts, preferably 45-55 mass parts, of carboxyl-containing compound and 60-40 mass parts, preferably 55-45 mass parts, of polyepoxide can be used.

Such carboxyl-containing compound is a compound having carboxyl group in its molecule, which can have an acid value within a range of normally 50-500 mgKOH/g, preferably 80-300 mgKOH/g.

As the carboxyl-containing compound, for example, the following polymers (1)-(3) and compound (4) can be named.

Polymer (1): Polymers Having Half-Esterified Acid Anhydride Group in Their Molecules Here the group formed by half-esterification of acid anhydride group signifies a group formed of carboxyl group and carbonic acid ester group which is obtained by adding aliphatic monoalcohol to acid anhydride group to cause the latter's ring-opening (i.e., half-esterification). Hereafter the group may be referred to simply as half-ester group.

The polymer (1) can be easily obtained by, for example, copolymerizing unsaturated monomer having half-ester group with other polymerizable unsaturated monomer by conventional means, or by carrying out similar copolymerization using unsaturated monomer having acid anhydride group instead of the half-ester group-containing unsaturated monomer and thereafter half-esterifying the acid anhydride group.

Examples of acid anhydride group-containing unsaturated monomer include maleic anhydride, itaconic anhydride and the like, and examples of half-ester group-containing unsaturated monomer include those acid anhydride group-containing unsaturated monomers whose acid anhydride groups are half-esterified. The half-esterification can be conducted either before or after the copolymerization reaction.

As examples of aliphatic monohydric alcohols useful for the half-esterification, low molecular weight monohydric alcohols such as methanol, ethanol, isopropanol, n-butanol, isobutanol, tert-butanol, ethylene glycol monomethyl ether and ethylene glycol monoethyl ether can be named. The half-esterification reaction can be carried out following conventional method, for example, at temperatures ranging from room temperature to around 80° C., where necessary, using tertiary amine as catalyst.

Examples of other polymerizable unsaturated monomer include hydroxyl containing unsaturated monomers, (meth) acrylic acid esters, vinyl ethers and allyl ethers, olefin compounds and diene compounds, hydrocarbon ring-containing unsaturated monomers, nitrogen-containing unsaturated monomers, hydrolyzable alkoxysilyl group-containing acrylic monomers and the like.

Examples of the hydroxyl-containing unsaturated monomer include $C_{2-8}$ hydroxyalkyl esters of acrylic acid or methacrylic acid such as 2-hydroxyethyl (meth)acrylate, 3-hydroxypropyl (meth)acrylate, hydroxybutyl (meth)acrylate and the like; monoesters of polyether polyols such as polyethylene glycol, polypropylene glycol, polybutylene glycol and the like with unsaturated carboxylic acids such as (meth) acrylic acid; monoethers of polyether polyols such as polyethylene glycol, polypropylene glycol, polybutylene glycol and the like with hydroxyalkyl esters of (meth)acrylic acid such as 2-hydroxyethyl (meth)acrylate; monoesters or diesters of acid anhydride group-containing unsaturated compounds such as maleic anhydride and itaconic anhydride, with glycols such as ethylene glycol, 1,6-hexanediol and neopentyl glycol; hydroxyalkylvinyl ethers such as hydroxyethylvinyl ether; allyl alcohol and the like; 2-hydroxypropyl (meth)acrylate; adducts of α,β-unsaturated carboxylic acid with monoepoxy compound such as Cardura E10P (tradename, HEXION Specialty Chemicals Co., glycidyl ester of synthetic highly branched saturated fatty acid) and α-olefin epoxide; adducts of glycidyl (meth)acrylate with monobasic acid such as acetic acid, propionic acid, p-tert-butylbenzoic acid and fatty acids; and adducts of above-named hydroxyl-containing unsaturated monomers with lactones (e.g., ε-caproloctone, γ-valerolactone).

Examples of (meth)acrylic acid ester include $C_{1-24}$ alkyl esters or cycloalkyl esters of acrylic acid or methacrylic acid such as methyl acrylate, ethyl acrylate, propyl acrylate, isopropyl acrylate, n-butyl acrylate, isobutyl acrylate, tert-butyl acrylate, hexyl acrylate, 2-ethylhexyl acrylate, n-octyl acrylate, decyl acrylate, stearyl acrylate, lauryl acrylate, cyclohexyl acrylate, methyl methacrylate, ethyl methacrylate, n-propyl methacrylate, isopropyl methacrylate, n-butyl methacrylate, isobutyl methacrylate, tert-butyl methacrylate, hexyl methacrylate, 2-ethylhexyl methacrylate, octyl methacrylate, decyl methacrylate, lauryl methacrylate, stearyl methacrylate, cyclohexyl methacrylate and the like; $C_{2-18}$ alkoxyalkyl esters of acrylic acid or methacrylic acid such as methoxybutyl acrylate, methoxybutyl methacrylate, methoxyethyl acrylate, methoxyethyl methacrylate, ethoxybutyl acrylate and ethoxybutyl methacrylate.

Examples of vinyl ether and allyl ether include chain alkyl vinyl ethers such as ethyl vinyl ether, n-propyl vinyl ether, isopropyl vinyl ether, butyl vinyl ether, tert-butyl vinyl ether, pentyl vinyl ether, hexyl vinyl ether and octyl vinyl ether; cycloalkyl vinyl ethers such as cyclopentyl vinyl ether and cyclohexyl vinyl ether; aryl vinyl ethers such as phenyl vinyl ether and tolyl vinyl ether; aralkyl vinyl ethers such as benzyl vinyl ether and phenethyl vinyl ether; and allyl ethers such as allyl ethyl ether.

Examples of olefin compound and diene compound include ethylene, propylene, butylene, vinyl chloride, butadiene, isoprene and chloroprene.

Examples of hydrocarbon ring-containing unsaturated monomer include styrene, a-methylstyrene, phenyl (meth) acrylate, phenylethyl (meth)acrylate, phenylpropyl (meth) acrylate, benzyl (meth)acrylate, phenoxyethyl (meth)acrylate, cyclohexyl (meth)acrylate, 2-acryloyloxyethyl hydrogenphthalate, 2-acryloyloxypropyl hydrogenphthalate, 2-acryloyloxypropyl hexahydrogenphthalate, 2-acryloyloxypropyl tetrahydrohydrogenphthalate, esters of p-tert-butylbenzoic acid with hydroxyethyl (meth)acrylate, dicyclopentenyl (meth)acrylate and the like.

Examples of nitrogen-containing unsaturated monomer include nitrogen-containing alkyl (meth)acrylate such as N, N-dimethylaminoethyl (meth)acrylate, N, N-diethylaminoethyl (meth)acrylate and N-tert-butylaminoethyl (meth)acrylate; polymerizable amides such as acrylamide, methacrylamide, N-methyl (meth)actylamide, N-ethyl (meth) acrylamide, N,N-dimethyl (meth)acrylamide, N,N-dimethylaminopropyl (meth)acrylamide and N,N-dimethylaminoethyl (meth)acrylamide; aromatic nitrogen-containing monomers such as 2-vinylpyridine, 1-vinyl-2-pyrrolidone and 4-vinylpyridine; polymerizable nitriles such as acrylonitrile and methacrylonitrile; and allylamine.

Examples of hydrolyzable alkoxysilyl group-containing acrylic monomer include γ-(meth)acryloyloxypropyltrimethoxysilane, γ-(meth)acryloyloxypropylmethyldimethoxysilane, β-(meth)acryloyloxyethyltrimethoxysilane, γ-(meth)acryloyloxypropyltriethoxysilane, γ-(meth) acryloyloxypropylmethyldiethoxysilane and the like.

Copolymerization of such unsaturated monomer having half-ester group or acid anhydride group with other copolymerizable unsaturated monomer can be carried out by general polymerization methods of unsaturated monomers, while solution type radical polymerization method in organic solvent is the most suitable in consideration of wider use and cost. For example, by carrying out the copolymerization reaction in a solvent such as aromatic solvent, e.g., xylene, toluene; ketone solvent, e.g., methyl ethyl ketone, methyl isobutyl ketone; ester solvent, e.g., ethyl acetate, butyl acetate, isobutyl acetate, 3-methoxybutyl acetate; or alcoholic solvent, e.g., n-butanol, isopropyl alcohol; in the presence of a polymerization initiator such as azo catalyst, peroxide catalyst or the like, at temperatures ranging around 60-150° C., the object polymer can be easily obtained.

Normally adequate copolymerization ratio of each of the half-ester group- or acid anhydride group-containing unsaturated monomer and other polymerizable unsaturated monomer is as follows, based on the combined mass of all the monomers: the half-ester group- or acid anhydride group-containing unsaturated monomer, within a range of generally 5-40 mass %, in particular, 10-30 mass %, from the viewpoints of curability and storage stability; and other polymerizable unsaturated monomer, within a range of generally 60-95 mass %, in particular, 70-90 mass %. Furthermore, it is adequate that the use amount of styrene among the other polymerizable unsaturated monomers is kept to no more than about 20 mass %, from the viewpoint of weatherability of cured coating film.

The polymer (1) is preferably an acrylic resin having a number-average molecular weight normally within a range of 1,000-20,000, in particular, 1,500-15,000. When number-average molecular weight of the polymer is less than 1,000, weatherability of cured coating film may be reduced. Whereas, when it exceeds 20,000, its compatibility with polyepoxide tends to drop.

Polymer (2): Polymers Having Carboxyl Group in Their Molecules

Polymer (2) can be readily obtained by copolymerizing carboxyl-containing unsaturated monomer with other polymerizable unsaturated monomer by the method similar to the case of polymer (1).

Examples of the carboxyl-containing unsaturated monomer include acrylic acid, methacrylic acid, crotonic acid, itaconic acid, maleic acid, fumaric acid, 2-carboxyethyl (meth)acrylate, 2-carboxypropyl (meth)acrylate, 5-carboxypentyl (meth)acrylate and the like, and as the other polymerizable unsaturated monomer, (meth)acrylic acid esters, vinyl ethers or allyl ethers, olefin compounds and diene compounds, hydrocarbon ring-containing unsaturated monomers, nitrogen-containing unsaturated monomers as exemplified in respect of the polymer (1) can be named.

In consideration of weatherability of cured coating film or compatibility with polyepoxide (B), the polymer (2) preferably has a number-average molecular weight normally within a range of 1,000-20,000, in particular, 1,500-15,000.

Polymer (3): Carboxyl-Containing Polyester Polymers

Carboxyl-containing polyester polymer can be readily obtained by condensation reaction of, for example, polyhydric alcohol, such as ethylene glycol, butylene glycol, 1,6-hexanediol, trimethylolpropane or pentaerythritol, with polyvalent carboxylic acid, such as adipic acid, terephthalic acid, isophthalic acid, phthalic anhydride, hexahydrophthalic anhydride. For example, the carboxyl-containing polyester polymer is obtainable by single stage reaction under the conditions in excess of carboxyl groups of the polyvalent carboxylic acid. Conversely, first a hydroxyl-terminated polyester polymer may be synthesized under the conditions in excess of hydroxyl groups of the polyhydric alcohol, to which an acid anhydride group-containing compound such as phthalic anhydride, hexahydrophthalic anhydride, succinic anhydride or the like is post-added to provide a carboxyl-containing polyester polymer.

The carboxyl-containing polyester polymer (3) adequately has a number-average molecular weight normally within a range of 500-20,000, in particular, 800-10,000.

Compound (4): Half-Esters Formed Through Reaction of Polyol with 1,2-Acid Anhydride The half-ester can be obtained through reaction of polyol with 1,2-acid anhydride under the conditions inducing ring-opening reaction of the acid anhydride but inducing substantially no polyesterification reaction. The reaction product generally has a low molecular weight and a narrow molecular weight distribution. The reaction product also shows a low content of volatile organic matter in the paint composition and furthermore imparts to the formed coating film excellent acid resistance and the like.

The half-ester is obtainable by, for example, reacting polyol with 1,2-acid anhydride in an inert atmosphere, e.g., in nitrogen atmosphere, in the presence of a solvent. Suitable solvents include, for example, ketones such as methyl amyl ketone, diisobutyl ketone, methyl isobutyl ketone; aromatic hydrocarbons such as toluene, xylene; and other organic solvents such as dimethylformamide, N-methylpyrrolidone and the like.

Low reaction temperatures such as not higher than about 150° C. are preferred. Specifically, normally about 70-about 150° C., in particular, about 90-about 120° C., are preferred. The reaction time basically varies more or less depending on the reaction temperature, which can be normally around 10 minutes-24 hours.

The reaction ratio of acid anhydride/polyol can be within a range of 0.8/1-1.2/1 in terms of equivalent ratio calculating the acid anhydride as being monofunctional, whereby the maximum of desired half-ester can be obtained.

The acid anhydrides useful for preparation of the desired half-esters are those containing 2-30, in particular, 5-20, carbon atoms, excepting the carbon atoms in the acid moiety. Examples of such acid anhydride include aliphatic acid anhydrides, cycloaliphatic acid anhydrides, olefinic acid anhydrides, cycloolefinic acid anhydrides and aromatic acid anhydrides. These acid anhydrides may have substituents, with the proviso that they have no detrimental effect on reactivity of the acid anhydrides or characteristic properties of resulting half-esters. Examples of the substituents include chloro, alkyl, alkoxy and like groups. Examples of the acid anhydride include succinic anhydride, methylsuccinic anhydride, dodecenylsuccinic anhydride, octadecenylsuccinic anhydride, phthalic anhydride, tetrahydrophthalic anhydride, methyltetrahydrophthalic anhydride, hexahydrophthalic anhydride, alkylhexahydrophthalic anhydride (e.g., methylhexahydrophthalic anhydride), tetrafluorophthalic anhydride, endomethylenetetrahydrophthalic anhydride, chlorendic anhydride, itaconic anhydride, cytraconic anhydride and maleic anhydride.

As the polyols useful for half-eslerification of above acid anhydrides, for example, $C_{2-20}$, in particular, $C_{2-10}$ polyols, preferably diols, triols and their mixtures can be named. Specific examples include aliphatic polyols such as ethylene glycol, 1,2-propanediol, 1,3-propanediol, 1,4-butanediol, 1,5-pentanediol, glycerol, 1,2,3-butanetriol, 1,6-hexanediol, neopentyl glycol, diethylene glycol, dipropylene glycol, 1,4-cyclohexanedimethanol, 3-methyl-1,5-pentanediol, trimethylolpropane, 2,2,4-trimethylpentane-1,3-diol, pentaerythritol, 1,2,3,4-butanetetraol and the like. Also aromatic polyols such as bisphenol A, bis(hydroxymethyl)xylene and the like may be used.

The half-ester can have a number-average molecular weight within a range of normally 400-1,000, in particular, 500-900. As it has high reactivity with epoxy group, it is useful for formulating high solid paint.

Polyepoxide which is used in combination with so far described carboxyl-containing compound is a compound having epoxy groups in its molecule. Those having an epoxy group content within a range of normally 0.8-15 millimols/g, in particular, 1.2-10 millimols/g are preferred.

As the polyepoxide, for example, epoxy-containing acrylic polymers; alicyclic epoxy-containing acrylic polymers; glycidyl ether compounds such as diglycidyl ether, 2-glycidylphenylglycidyl ether, 2,6-diglycidylphenylglycidyl ether and the like; compounds containing glycidyl group and alicyclic epoxy group, such as vinylcyclohexene dioxide, limonene dioxide and the like; and alicyclic epoxy-containing compounds such as dicyclopentadiene dioxide, bis(2,3-epoxycyclopentyl) ether, epoxycyclohexenecarboxylic acid ethylene glycol diester, bis(3,4-epoxycyclohexylmethyl)adipate, 3,4-epoxycyclohexylmethyl-3,4-epoxycyclohexanecarboxylate, 3,4-epoxy-6-methylcyclohexylmethyl-3,4-epoxy-6-methylcyclohexanecarboxylate and the like can be named, which can be used either alone or in combination of two or more.

Of these, epoxy-containing acrylic polymers or alicyclic epoxy-containing acrylic polymers having a number-average molecular weight within a range of generally 1,000-20,000, in particular, 1,500-15,000 are preferably used.

Such epoxy-containing acrylic polymers or alicyclic epoxy-containing acrylic polymers can be easily obtained by copolymerizing epoxy-containing unsaturated monomers or alicyclic epoxy-containing unsaturated monomers and other polymerizable unsaturated monomers by the methods similar to the case of the polymer (1).

As the epoxy-containing unsaturated monomer, for example, glycidyl (meth)acrylate, allyl glycidyl ether and the like can be named, and as the alicyclic epoxy group-containing unsaturated monomer, for example, 3,4-epoxycyclohexylmethyl (meth)acrylate and the like can be named.

Examples of the other polymerizable unsaturated monomers include those exemplified as to the polymer (1), i.e., hydroxyl-containing unsaturated monomers, (meth)acrylic acid esters, vinyl ethers or allyl ethers, olefin compounds and diene compounds, hydrocarbon ring-containing unsaturated monomers, nitrogen-containing unsaturated monomers, hydrolyzable alkoxysilyl group-containing acrylic monomers and the like.

Preferred blend ratio of the carboxyl-containing compound and polyepoxide in the clear paint (Z) can be, in terms of the equivalent ratio between the carboxyl groups in the carboxyl-containing compound and the epoxy groups in the polyepoxide, within a range of generally 1/0.5-0.5/1, in particular, 1/0.7-0.7/1, inter alia, 1/0.8-0.8/1, from the viewpoint of curability of the coating film.

Where necessary, curing catalyst may be blended in the clear paint (Z). Examples of useful curing catalyst include, as those catalysts effective for the ring-opening esterification reaction between the carboxyl groups in the carboxyl-containing compound and the epoxy groups in the polyepoxide, quaternary salt catalysts such as tetraethylammonium bromide, tetrabutylammonium bromide, tetraethylammonium chloride, tetrabutylphosphonium bromide, triphenylbenzylphosphonium chloride and the like; and amine compounds such as triethylamine, tributylamine and the like. Of these, quaternary salt catalysts are preferred. Furthermore, quaternary salt which is blended with approximately equivalent acidic phosphoric acid compound such as dibutylphosphoric acid is favorable in that it can improve storage stability of the paint and prevent deterioration in spray-coatability of the paint due to decrease in its electric resistance, without impairing the catalytic action.

Where the curing catalyst is blended, its suitable blend ratio is normally about 0.01-5 mass parts, per 100 mass parts of total solid content of the carboxyl-containing compound and polyepoxide.

The clear paint (Z) may also contain, where necessary, coloring pigment, effect pigment, dye and the like to an extent not impairing transparency, and may further suitably contain extender, UV absorber, defoamer, thickener, rust-preventive agent, surface regulating agent, organic solvent and the like.

The clear paint (Z) can be applied onto the coated film surface of the water-based base coating paint (Y) by a method known per se, such as airless spray, air spray, rotary atomizing coater or the like. Static electricity may be impressed during the coating time. The coating film thickness can be made within a range of normally 10-60 μm, preferably 25-50 μm, in terms of cured film thickness.

Step (6):

The multilayer coating film formed of the three layers of the intermediate coating film, base coating film and clear coating film as formed in the above-described steps (1)-(5) is baked and cured simultaneously, by heating at about 100-about 120° C. for about 3-10 minutes, and then further heated at about 130-about 160° C. for about 10-30 minutes.

The heating can be carried out by ordinary baking means of coating film, such as hot air heating, infrared heating, high frequency heating and the like. Specifically, for example, a method comprising placing a coating object, onto which the water-based intermediate paint (X), water-based base coating paint (Y) and clear paint (Z) have been successively applied, in a drying oven whose temperature is adjusted to about 100-about 120° C., keeping the object in the oven for 3-10 minutes, thereafter adjusting the temperature of the drying oven to about 130-about 160° C., and keeping the object therein to heat the same for 10-30 minutes; a method comprising preparing a tunnel dryer having an entrance and exit at its respective ends, through which an object is transferred by a belt conveyor to be dried, dividing inside of the tunnel into a low temperature zone and a high temperature zone, the temperature setting being about 100-about 120° C. at the low temperature zone and at about 130-about 160° C. at the high temperature zone, first passing the object through the low temperature zone consuming 3-10 minutes, and thereafter passing it through the high temperature zone consuming 10-30 minutes; a method comprising preparing a first drying oven whose temperature is adjusted to about 100-about 120° C. and a second drying oven whose temperature is adjusted to about 130-about 160° C., keeping the coating object onto which the water-based intermediate paint (X), water-based base coating paint (Y) and clear paint (Z) have been successively applied, in the first drying oven for 3-10 minutes, and subsequently keeping the same object in the second drying oven for 10-30 minutes; and the like methods can be used.

The reason why the application of the coating film-forming method of the present invention in the occasion of coating a water-based intermediate paint and water-based base coating paint by 3-coat-1-bake system enables formation of multilayer coating film excelling in smoothness and distinctness of image is not necessarily clear. It is inferred that the clear paint can uniformly spread in wet condition over the base coating film, as the clear paint comprising the carboxyl-containing compound and polyepoxide is applied onto the base coating film, under the conditions that the intermediate coating film and base coating film have relatively high solid contents and the volatile component remaining in the base coating film contains a large amount of alcoholic solvent having relatively high boiling point; and further by the two-stage heating, the solvent in the paint such as the alcoholic solvent is gently volatilized to form a multilayer coating film excelling in smoothness and distinctness of image.

EXAMPLES

Hereinafter the invention is explained more specifically, referring to working Examples and Comparative Examples, it being understood that the invention is not limited to these Examples only. "Part" and "%" appearing hereafter are by mass.

Production of Hydroxyl-Containing Acrylic Resin (A1)

Production Example 1

A reactor equipped with a thermometer, thermostat, stirrer, reflux condenser and dropping device was charged with 70.7 parts of deionized water and 0.52 part of AQUALON KH-10 (tradename, Daiichi Kogyo Seiyaku Co., Ltd., emulsifier, active component, 97%), which were stirred and mixed in a nitrogen gas current, and heated to 80° C. Then 1% of the total amount of the following monomeric emulsion and 5 parts of 6% aqueous ammonium persulfate solution were introduced into the reactor and kept at 80° C. for 15 minutes. The remainder of the monomeric emulsion was dropped into the reactor which was maintained at the same temperature, over 3 hours, followed by 1 hour's aging. Then 40 parts of 5% aqueous 2-(dimethyamino)ethanol solution was gradually added to the reactor to cool the latter to 30° C. The content of the reactor was discharged while being filtered through 100-mesh Nylon cloth, to provide a hydroxyl-containing acrylic resin emulsion (A1-1) having a solid concentration of 45%. Thus obtained hydroxyl-containing acrylic resin emulsion had an acid value of 12 mgKOH/g and a hydroxyl value of 43 mgKOH/g.

Monomeric emulsion: Mixing by stirring 50 parts of deionized water, 10 parts of styrene, 40 parts of methyl methacrylate, 35 parts of ethyl acrylate, 3.5 parts of n-butyl methacrylate, 10 parts of 2-hydroxyethyl methacrylate, 1.5 parts of acrylic acid, 1.0 part of AQUALON KH-10 and 0.03 part of ammonium persulfate, the monomeric emulsion was obtained.

Production Example 2

A reactor equipped with a thermometer, thermostat, stirrer, reflux condenser and dropping device was charged with 130 parts of deionized water and 0.52 part of AQUALON KH-10 which were stirred and mixed in a nitrogen gas current, and the temperature was raised to 80° C. Then 1% of the total amount of the following monomeric emulsion (1) and 5.3 parts of 6% aqueous ammonium persulfate solution were introduced into the reactor and kept at 80° C. for 15 minutes. The remainder of the monomeric emulsion (1) was dropped into the reactor which was maintained at the same temperature, over 3 hours, followed by 1 hour's aging. Thereafter the following monomeric emulsion (2) was added dropwise over an hour, and after the subsequent 1 hour's aging, the reactor was cooled to 30° C. under gradual addition of 40 parts of 5% aqueous dimethylethanolamine solution thereinto. The content of the reactor was discharged while being filtered through 100-mesh Nylon cloth, to provide a hydroxyl-containing acrylic resin emulsion (A1-2) having an average particle size of 100 nm (as measured with a submicron particle size distribution-measuring device, COULTER N4 type (tradename, Beckman Coulter, Inc.) for the sample as diluted with deionized water, at 20° C.) and a solid concentration of 30%. Thus obtained hydroxyl-containing acrylic resin had an acid value of 33 mgKOH/g and a hydroxyl value of 25 mgKOH/g.

Monomeric emulsion (1): Mixing by stirring 42 parts of deionized water, 0.72 part of AQUALON KH-10, 2.1 parts of methylenebisacrylamide, 2.8 parts of styrene, 16.1 parts of methyl methacrylate, 28 parts of ethyl acrylate and 21 parts of n-butyl acrylate, monomeric emulsion (1) was obtained.

Monomeric emulsion (2): Mixing and stirring 18 parts of deionized water, 0.31 part of AQUALON KH-10, 0.03 part of ammonium persulfate, 5.1 parts of methacrylic acid, 5.1 parts of 2-hydroxyethyl acrylate, 3 parts of styrene, 6 parts of methyl methacrylate, 1.8 parts of ethyl acrylate and 9 parts of n-butyl acrylate, monomeric emulsion (2) was obtained.

Production of Hydroxyl-Containing Polyester Resin (A2)

Production Example 3

A reactor equipped with a thermometer, thermostat, stirrer, reflux condenser and water separator was charged with 174 parts of trimethylolpropane, 327 parts of neopentyl glycol, 352 parts of adipic acid, 109 parts of isophthalic acid and 101 parts of 1,2-cyclohexanedicarboxylic anhydride, and the temperature was raised from 160° C. to 230° C. over 3 hours. Distilling the water of condensation off as it was formed with the water separator, the system was maintained at 230° C. and the reaction was continued until the reaction product came to have an acid value not higher than 3 mgKOH/g. To this reaction product 59 parts of trimellitic anhydride was added, followed by 30 minutes' addition reaction at 170° C. Cooling the product to not higher than 50° C., adding an equivalent amount to the acid groups of 2-(dimethylamino)ethanol to neutralize the product, and gradually adding thereto deionized water, a hydroxyl-containing polyester resin solution (A2-1) having a solid concentration of 45% and pH 7.2 was obtained. The resulting hydroxyl-containing polyester resin had an acid value of 35 mgKOH/g, hydroxyl value of 128 mgKOH/g and weight-average molecular weight of 13,000.

Production Example 4

A reactor equipped with a thermometer, thermostat, stirrer, reflux condenser and water separator was charged with 109 parts of trimethylolpropane, 141 parts of 1,6-hexanediol, 126 parts of hexahydrophthalic anhydride and 120 parts of adipic acid, and heated. The temperature was raised from 160° C. to 230° C. over 3 hours, and then condensation reaction was carried out at 230° C. for 4 hours. To the resulting condensation reaction product, 38.3 parts of trimellitic anhydride was added to add carboxyl groups thereto and reacted at 170° C. for 30 minutes, and the reaction product was diluted with 1-octanol (an alcoholic solvent having a boiling point of 195° C.), to provide a hydroxyl-containing polyester resin solution (A2-2) having a solid concentration of 70%. Thus obtained hydroxyl-containing polyester resin had an acid value of 46 mgKOH/g, hydroxyl value of 150 mgKOH/g and weight-average molecular weight of 6,400.

Formulation of Water-Based Intermediate Paint (X)

Production Example 5

A pigment-dispersed paste was obtained by mixing 56 parts of the hydroxyl-containing polyester resin solution (A2-1) as obtained in Production Example 3 (solid resin content, 25 parts), 60 parts of JR-806 (tradename, TAYCA Corporation, rutile type titanium dioxide), 1 part of Carbon MA-100 (tradename, Mitsubishi Chemicals Co., carbon black), 15 parts of BARIACE B-35 (tradename, Sakai Chemical Industry Co., Ltd., barium sulfate powder, average primary particle diameter, 0.5 μm), 3 parts of MICRO ACE S-3 (tradename, Nippon Talc Co., talc powder, average primary particle diameter, 4.8 μm) and 5 parts of deionized water, adjusting the pH of the formulation to 8.0 with 2-(dimethylamino)ethanol, and dispersing the same with a paint shaker for 30 minutes.

Then, 140 parts of the resulting pigment-dispersed paste, 33 parts of the hydroxyl-containing acrylic resin emulsion (A1-1) as obtained in Production Example 1, 33 parts of the hydroxyl-containing polyester resin solution (B1-1) as obtained in Production Example 3, 37.5 parts of CYMEL 325 (tradename, Nippon Cytec Industries Co., melamine resin, solid content 80%), 26 parts of BYHYDUR VPLS 2310 (tradename, Sumika Bayer Urethane Co., Ltd., blocked polyisocyanate compound, solid content 38%) and 43 parts of UCOAT UX-8100 (tradename, Sanyo Chemical Industries, Ltd., urethane emulsion, solid content 35%) were homogeneously mixed.

To the resulting mixture than UH-752 (tradename, ADEKA Corporation, thickener), 2-(dimethylamino)ethanol and deionized water were added to provide a water-based intermediate paint (X-1) of pH 8.0, having a solid paint content of 48% and a viscosity of 30 seconds at 20° C. as measured with Ford cup No. 4.

Production Example of Effect Pigment Concentrate

Production Example 6

In an agitation mixing vessel, 19 parts of an aluminum pigment paste, GX-180A (tradename, Asahikasei Metals Co., metal content 74%), 35 parts of 1-octanol (alcoholic solvent having a boiling point of 195°), 8 parts of phosphate group-containing resin solution(note 1) and 0.2 part of 2-(dimethylamino)ethanol were homogeneously mixed to provide an effect pigment concentrate (P-1).

(Note 1) Phosphate group-containing resin solution: A reactor equipped with a thermometer, thermostat, stirrer, reflux condenser and dropping device was charged with a mixed solvent formed of 27.5 parts of methoxypropanol and 27.5 parts of isobutanol. Heating the same to 110° C., 121.5 parts of a mixture formed of 25 parts of styrene, 27.5 parts of n-butyl methacrylate, 20 parts of Isostearyl Acrylate (tradename, Osaka Organic Chemical Industry, Ltd., branched higher alkyl acrylate), 7.5 parts of 4-hydroxybutyl acrylate, 15 parts of phosphate group-containing polymerizable monomer(note 2), 12.5 parts of 2-methacryloyloxyethyl acid phosphate, 10 parts of isobutanol and 4 parts of t-butylperoxyoctanoate was added thereto over 4 hours. Further a mixture formed of 0.5 part of t-butylperoxyoctanoate and 20 parts of isopropanol was added dropwise over an hour. After the following an hour's aging under stirring, a phosphate group-containing resin solution having a solid concentration of 50% was obtained. The acid value of this resin attributable to the phosphate groups was 83 mgKOH/g, hydroxyl value was 29 mgKOH/g, and weight-average molecular weight was 10,000.

(Note 2) Phosphate group-containing polymerizable monomer: A reactor equipped with a thermometer, thermostat, stirrer, reflux condenser and dropping device was charged with 57.5 parts of monobutylphosphoric acid and 41 parts of isobutanol. Raising the temperature to 90° C., 42.5 parts of glycidyl methacrylate was added dropwise over 2 hours, followed by an hour's aging under stirring. Then 59 parts of isopropanol was added to provide a phosphate group-containing polymerizable monomer solution having a solid concentration of 50%. Thus obtained monomer had an acid value attributable to the phosphate groups of 285 mgKOH/g.

Production Example 7

An effect pigment concentrate (P-2) was obtained in the manner similar to Production Example 6, except that the 35 parts of 1-octanol was changed to 35 parts of 2-ethyl-1-hexanol (alcoholic solvent having a boiling point of 184° C.).

Production Example 8

An effect pigment concentrate (P-3) was obtained in the manner similar to Production Example 6, except that the 35 parts of 1-octanol was changed to a mixed solvent formed of 25 parts of 2-ethyl-1-hexanol (alcoholic solvent having a boiling point of 184° C.) and 10 parts of 1-hexanol (alcoholic solvent having a boiling point of 157° C.).

Production Example 9

An effect pigment concentrate (P-4) was obtained in the manner similar to Production Example 6, except that the 35 parts of 1-octanol was changed to 35 parts of 1-hexanol (alcoholic solvent having a boiling point of 157° C.).

Production Example 10

An effect pigment concentrate (P-5) was obtained in the manner similar to Production Example 6, except that the 35 parts of 1-octanol was changed to 35 parts of ethyl-3-ethoxypropionate (ester solvent having a boiling point of 170° C.).

Production of Water-Based Base Coating Paint (Y)

Production Example 11

One-hundred (100) parts of the hydroxyl-containing acrylic resin emulsion (A1-2) as obtained in Production Example 2, 57 parts of the hydroxyl-containing polyester resin solution (A2-2) as obtained in Production Example 4, 62 parts of the effect pigment concentrate (P-1) as obtained in Production Example 6 and 37.5 parts of Cymel 325 (tradename, Nihon Cytec Industries, Inc., melamine resin, solid content 80%) were homogeneously mixed, and further PRIMAL ASE-60 (tradename, Rohm & Haas Co., thickener), 2-(dimethylamino)ethanol and deionized water were added to provide a water-based base coating paint (Y-1) of pH 8.0, having a solid paint content of 25% and a viscosity of 40 seconds at 20° C. as measured with Ford cup No. 4.

Production Examples 12-15

Production Example 11 was repeated except that the effect pigment concentrate (P-1) was changed to the effect pigment concentrate as indicated in the later-appearing Table 1 in each run, to provide water-based base coating paints (Y-2)-(Y-5) of pH 8.0, having a solid paint content of 25% and a viscosity of 40 seconds at 20° C. as measured with Ford cup No. 4.

Production of Carboxyl-Containing Compound

Production Example 16

A reactor equipped with a thermometer, thermostat, stirrer, reflux condenser, nitrogen gas inlet pipe and dropping device was charged with 680 parts of SWAZOL 1000 (tradename, COSMO Oil Co., Ltd., hydrocarbon organic solvent), and its temperature was raised to 125° C. under nitrogen gas passage. When 125° C. was reached, nitrogen gas supply was stopped, and into the reactor a monomeric mixture of the composition as specified below was added dropwise at a constant rate, consuming 4 hours. In the mixture, p-tert-butylperoxy-2-ethyl hexanoate is a polymerization initiator.

Monomeric mixture: A monomeric mixture was obtained by mixing and stirring 500 parts of styrene, 500 parts of cyclohexyl methacrylate, 500 parts of isobutyl methacrylate, 500 parts of maleic anhydride, 1000 parts of 2-ethoxyethyl propionate and 100 parts of p-tert-butylperoxy-2-ethyl hexanoate.

Then the system was aged for 30 minutes while passing nitrogen gas at 125° C., and further a mixture of 10 parts of p-tert-butylperoxy-2-ethyl hexanoate and 80 parts of SWAZOL 1000 was added dropwise over an hour. Cooling the system to 60° C., 490 parts of methanol and 4 parts of triethylamine were added to carry out the half-esterification reaction for 4 hours by heating under reflux. Then 326 parts of the excessive methanol was removed under reduced pressure to provide a carboxyl-containing compound solution having a solid content of 55%. The carboxyl-containing compound had a number-average molecular weight of 3,500 and an acid value of 130 mgKOH/g.

Production of Polyepoxide

Production Example 17

A reactor equipped with a thermometer, thermostat, stirrer, reflux condenser, nitrogen gas inlet pipe and dropping device was charged with 410 parts of xylene and 77 parts of n-butanol, and its temperature was raised to 125° C. under nitrogen gas passage. When 125° C. was reached, nitrogen gas supply was stopped, and into the reactor a monomeric mixture of the composition as specified below was added dropwise at a constant rate, consuming 4 hours. In the mixture, azobisisobutyronitrile is a polymerization initiator.

Monomeric mixture: A monomeric mixture was obtained by mixing and stirring 432 parts (30%) of glycidyl methacrylate, 720 parts (50%) of n-butyl acrylate, 288 parts (20%) of styrene and 72 parts of azobisisobutyronitrile.

Then the system was aged for 30 minutes while passing nitrogen gas at 125° C., and further a mixture of 90 parts of xylene, 40 parts of n-butanol and 14.4 parts of azobisisobutyronitrile was added dropwise over 2 hours. Aging the system for subsequent 2 hours, a polyepoxide solution having a solid content of 70% was obtained. Thus obtained polyepoxide had a number-average molecular weight of 2,000 and an epoxy group content of 2.12 mmols/g.

Formulation of Clear Paint (Z)

Production Example 18

Ninty-one (91) parts of the carboxyl-containing compound solution (solid content 50 parts) as obtained in Production Example 16, 71 parts of the polyepoxide solution (solid content 50 parts) as obtained in Production Example 17, 1 part of TBAB (tradename, Lion Akzo K.K., tetrabutylammonium bromide, active component 100%) and 0.2 part of BYK-300 (tradename, BYK Chemie GmgH, surface regulating agent, active component 52%) were homogeneously mixed. Further adding thereto SWAZOL 1000 (tradename, Cosmo Oil Co., hydrocarbon solvent), a clear paint (Z-1) having a viscosity of 25 seconds at 20° C. as measured with Ford cup No. 4 was obtained.

Coating Film-Forming Method

Using the water-based intermediate paint (X-1) as obtained in Production Example 5, water-based base coating paints (Y-1)-(Y-5) as obtained in Production Examples 11-15, the clear paint (Z-1) as obtained in Production Example 18 and MAGICRON TC-71 (tradename, Kansai Paint Co., thermosetting clear paint comprising hydroxyl-containing acrylic resin and melamine resin, which hereafter may be referred to as "clear paint (Z-2)", test panels were prepared as follows, and their evaluation tests were conducted.

(Preparation of Coated Objects for Tests)

Zinc phosphate-treated cold-rolled steel sheets were electrocoated with ELECRON GT-10 (tradename, Kansai Paint Co., cationic electrodeposition coating) to a dry film thickness of 20 μm, and heated at 170° C. for 30 minutes to cure the coating film, to provide coated objects for the tests.

Example 1

Onto the above coated sample the water-based intermediate paint (X-1) as obtained in Production Example 5 was electrostatically coated to a dry film thickness of 25 μm with a rotary atomizing type electrostatic coater, left to stand for the following 2 minutes, and preheated at 80° C. for 3 minutes. The solid paint content of the intermediate coating film after the preheating was 90 mass %.

Then onto the uncured intermediate coating film, the water-based base coating paint (Y-1) as obtained in Production Example 11 was electrostatically coated to a dry film thickness of 15 μm with a rotary atomizing type electrostatic coater, left to stand for 2 minutes, and preheated at 80° C. for 3 minutes. The solid paint content of the base coating film after the preheating was 85 mass %.

Further onto the base coating film the clear paint (Z-1) as obtained in Production Example 18 was electrostatically coated to a dry film thickness of 35 μm and left to stand for 7 minutes. Then the coated test sample was kept in a first drying oven maintained at 105° C. for 7 minutes, and transferred to a second drying oven maintained at 140° C. Keeping it in the second drying oven for 20 minutes, a test panel was prepared upon baking and curing the intermediate film, base coating film and clear coating film.

Examples 2-3, Comparative Examples 1-6

Example 1 was repeated to prepare test panels except that: the preheating conditions after application of the water-based intermediate paint as indicated in the following Table 1 were adopted; the water-based base coating paint (Y-1) in certain cases was changed to one of those water-based base coating paints (Y-2)-(Y-5) as indicated in Table 1; the preheating conditions after application of the water-based base coating paint were as shown in Table 1; the clear paint (Z-1) in certain cases was changed to (Z-2); and the baking and curing conditions of the coating films as indicated in Table 1 were adopted.

Evaluation Tests

The test panels as obtained in above Examples 1-3 and Comparative Examples 1-6 were evaluated by the following test methods. The results of the evaluation were as shown in the following Table 1.

(Test Method)

Smoothness: evaluated by Wc values which were measured with Wave Scan DOI (tradename, BYK Gardner Co.). Wc value is an index of amplitude of surface roughness of the wavelength ranging about 1-3 mm, and the less the measured value, the better the smoothness of the coated surface.

Distinctness of image: evaluated by Wa values which were measured with Wave Scan DOI. Wa value is an index of amplitude of surface roughness of the wavelength ranging about 0.1-0.3 mm, and the less the measured value, the better the distinctness of image of the coated surface.

TABLE 1

| | | | | Example | | | Comparative Example | | | | | |
|---|---|---|---|---|---|---|---|---|---|---|---|---|
| | | | | 1 | 2 | 3 | 1 | 2 | 3 | 4 | 5 | 6 |
| Step 1 | Water-based intermediate paint (X) | | | X-1 | X-1 | X-1 | X-1 | X-1 | X-1 | X-1 | X-1 | X-1 |
| Step 2 | Preheating conditions | | temp. (° C.) | 80 | 80 | 80 | 80 | 80 | 40 | 80 | 80 | 80 |
| | | | time (min.) | 3 | 3 | 3 | 3 | 3 | 2 | 3 | 3 | 3 |
| | Solid paint content (%) of intermediate coating film after preheating | | | 90 | 90 | 90 | 90 | 90 | 65 | 90 | 90 | 90 |
| Step 3 | Water-based | paint | | Y-1 | Y-2 | Y-3 | Y-4 | Y-5 | Y-1 | Y-1 | Y-1 | Y-1 |
| | base coating | effect pigment concentrate | | P-1 | P-2 | P-3 | P-4 | P-5 | P-1 | P-1 | P-1 | P-1 |
| | paint (Y) | content of | 1-octanol (bp 195° C.) | 52 | 17 | 17 | 17 | 17 | 52 | 52 | 52 | 52 |
| | | solvent (parts) | 2-ethyl-1-hexanol (bp 184° C.) | | 35 | 25 | | | | | | |
| | | per 100 mass | 1-hexanol (bp 157° C.) | | | 10 | 35 | | | | | |
| | | parts of solid resin content | ethyl-3-ethoxypropionate (bp 170° C.) | | | | | 35 | | | | |
| Step 4 | Preheating conditions | | temp. (° C.) | 80 | 80 | 80 | 80 | 80 | 40 | 80 | 80 | 80 |
| | | | time (min.) | 3 | 3 | 3 | 3 | 3 | 3 | 3 | 3 | 3 |
| | Solid paint content of base coating paint after preheating | | | 85 | 87 | 88 | 95 | 87 | 65 | 85 | 85 | 85 |
| Step 5 | Clear paint (Z) | | | Z-1 | Z-1 | Z-1 | Z-1 | Z-1 | Z-1 | Z-1 | Z-1 | Z-2 |
| Step 6 | Baking | 1st stage | temp. (° C.) | 105 | 110 | 115 | 105 | 105 | 105 | 80 | 140 | 110 |
| | conditions | | time (min.) | 7 | 6 | 5 | 7 | 7 | 7 | 6 | 30 | 6 |
| | | 2nd stage | temp. (° C.) | 140 | 140 | 140 | 140 | 140 | 140 | 140 | | 140 |
| | | | time (min.) | 20 | 25 | 25 | 20 | 20 | 20 | 20 | | 20 |
| Evaluation | smoothness | | | 14.2 | 14.9 | 15.4 | 23.5 | 24.5 | 25.5 | 22.5 | 23.8 | 24.1 |
| | distinctness of image | | | 13.5 | 13.8 | 14.9 | 22.3 | 23.1 | 24.2 | 21.3 | 21.5 | 23.3 |

The invention claimed is:

1. A method for forming a multilayer coating film on a coating object, which comprises successively carrying out the following steps (1-6):

(1) a step of applying a water-based intermediate paint (X), which comprises a hydroxyl-containing acrylic resin and a hydroxyl-containing polyester resin as a base resin, and an amino resin and a blocked polyisocyanate compound as a crosslinking agent, to form an intermediate coating film, (2) a step of adjusting a solid content of the intermediate coating film which is formed in the step (1) to 70-100 mass %, (3) a step of forming a base coating film by applying onto the intermediate coating film as obtained in the step (2) a water-based base coating paint (Y), which comprises a hydroxyl-containing acrylic resin and a hydroxyl-containing polyester resin as a base resin, and an amino resin as a crosslinking agent, and which comprises 30-55 mass parts, per 100 mass parts of a solid resin content of the paint (Y), of an alcoholic solvent having a boiling point of 170-250° C., (4) a step of adjusting a solid content of the base coating film which is formed in the step (3) to 70-100 mass % and pre-heating the intermediate coating film and the base coating film at 30-100° C. for 30 seconds-15 minutes, (5) a step of forming a clear coating film by applying onto the base coating film as obtained in the step (4) a clear paint (Z) containing 40-60 mass parts a of carboxyl-containing compound and 60-40 mass parts of a polyepoxide, per 100 mass parts of a solid resin content of the paint (Z), and (6) a step of curing the intermediate coating film, base coating film and clear coating film, which are formed in the steps (1)-(5), simultaneously, by heating them at 100-120° C. for 3-10 minutes and thereafter further heating them at 130-160° C. for 10-30 minutes.

2. The method according to claim 1, in which the solid content of the intermediate coating film which is formed in the step (1) is adjusted to 75-99 mass % in the step (2).

3. The method according to claim 1, in which the intermediate coating film is preheated at 30-100° C. for 30 seconds-15 minutes in the step (2).

4. The method according to claim 1, in which the alcoholic solvent having a boiling point of 170-250° C. which is contained in the water-based base coating paint (Y) is selected from the group consisting of 1-octanol, 2-octanol, 2-ethyl-1-hexanol and ethylene glycol mono-2-ethylhexyl ether.

5. The method according to claim 1, in which the content of the alcoholic solvent having a boiling point of 170-250° C. in the water-based base coating paint (Y) is 35-55 mass parts based on 100 mass parts of the solid resin content of the paint.

6. The method according to claim 1, in which the solid content of the base coating film which is formed in the step (3) is adjusted to 75-99 mass % in the step (4).

7. The method according to claim 1, in which the clear paint (Z) comprises 45-55 mass parts of the carboxyl-containing compound and 55-45 mass parts of the polyepoxide, based on 100 mass parts of the solid resin content of the paint.

8. The method according to claim 1, in which the carboxyl-containing compound in the clear paint (Z) is selected from the group consisting of a polymer having in its molecule a half-esterified acid anhydride group, a polymer having in its molecule a carboxyl group, a carboxyl-containing polyester polymer and a half-ester formed by reaction of a polyol with a 1,2-acid anhydride.

9. The method according to claim 1, in which the polyepoxide in the clear paint (Z) is an epoxy group-containing acrylic polymer or alicyclic epoxy group-containing acrylic polymer, having a number-average molecular weight of 1,000-20,000.

10. The method according to claim 1, in which the coating object is a car body on which an undercoat coating film is formed by electrodeposition coating.

* * * * *